US008057018B2

(12) United States Patent
Yazaki et al.

(10) Patent No.: US 8,057,018 B2
(45) Date of Patent: Nov. 15, 2011

(54) METHOD OF MANUFACTURING A LIQUID JET HEAD AND A LIQUID JET APPARATUS

(75) Inventors: Shiro Yazaki, Chino (JP); Setsuya Iwashita, Nirasaki (JP); Eiju Hirai, Fujimi-machi (JP); Tsutomu Nishiwaki, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 437 days.

(21) Appl. No.: 12/391,910

(22) Filed: Feb. 24, 2009

(65) Prior Publication Data

US 2009/0219345 A1 Sep. 3, 2009

(30) Foreign Application Priority Data

Feb. 25, 2008 (JP) ..... 2008-043652

(51) Int. Cl.
*B41J 2/045* (2006.01)
*H04R 17/00* (2006.01)

(52) U.S. Cl. ..... 347/68; 29/25.35

(58) Field of Classification Search ..... 347/68, 347/69, 70–72; 29/25.35, 890.1, 611
See application file for complete search history.

(56) References Cited

U.S. PATENT DOCUMENTS 6,243,941 B1 * 6/2001 Kashiwaya et al. ..... 29/611
7,681,989 B2 * 3/2010 Lee et al. ..... 347/70
2007/0199185 A1 * 8/2007 Thalhammer et al. ..... 29/25.35

FOREIGN PATENT DOCUMENTS

JP 2005-088441 A 4/2005

* cited by examiner

*Primary Examiner* — Kristal Feggins
(74) *Attorney, Agent, or Firm* — Kilpatrick Townsend & Stockton LLP

(57) ABSTRACT

A method of manufacturing a liquid jet head includes depositing a lower electrode film on a passage forming substrate and patterning the lower electrode film into a predetermined pattern, forming a piezoelectric layer on the passage forming substrate, forming an intermediate film made of a conductive material on the piezoelectric layer, forming a protective film on the intermediate film and, using the protective film as a mask, patterning by etching the piezoelectric layer together with the intermediate film into a predetermined pattern, peeling off the protective film, and depositing an upper electrode film on the passage forming substrate and patterning the upper electrode film into a predetermined pattern.

5 Claims, 14 Drawing Sheets

METHOD OF MANUFACTURING A LIQUID JET HEAD AND A LIQUID JET APPARATUS

CROSS REFERENCES TO RELATED APPLICATIONS

The present invention claims the priority of Japanese Patent Application No. 2007-329089 filed in the Japanese Patent Office on Feb. 25, 2008, the entire contents of which are incorporated herein by reference.

BACKGROUND OF THE INVENTION

1. Field of the Invention

The present invention relates to a method of manufacturing a liquid jet head and a liquid jet apparatus.

2. Description of the Related Art

A piezoelectric element for use in a liquid jet head has a problem of susceptibility to damage resulting from, for example, exposure to an external environment such as moisture. To solve this problem, the periphery of a piezoelectric layer covered with an upper electrode, for example, is disclosed in Japanese Unexamined Patent Application Publication No. 2005-88441. If a piezoelectric element is formed by depositing and patterning a lower electrode film, a piezoelectric layer, and an upper electrode film individually as described above, the piezoelectric layer is subject to damage during manufacturing processes, resulting in deterioration of displacement properties of the piezoelectric element. Specifically, a piezoelectric layer is etched via, for example, a protective film consisting of a resist and patterned into a predetermined pattern. After the piezoelectric layer is patterned, peeling off such a protective film of a resist followed by washing the surface of the piezoelectric layer is performed. An acid or alkaline solution may be used as a peeling solution for use in the peeling step or a cleaning solution for use in the washing step. However, such a solution adhering to the piezoelectric layer may damage the piezoelectric layer, resulting in deterioration of various properties including displacement properties of the piezoelectric element.

BRIEF SUMMARY OF THE INVENTION

The present invention has been achieved to solve at least some of the above-described problems and can be realized as an embodiment described below.

An embodiment to which the present invention is applicable is a method of manufacturing a liquid jet head, including forming a pressure generating chamber in a passage forming substrate, forming a lower electrode film having a smaller width than the pressure generating chamber in a region opposite to the pressure generating chamber, forming a piezoelectric layer so as to cover the top and end faces of the lower electrode film in a region opposite to the pressure generating chamber, forming an upper electrode film so as to cover top and end faces of the piezoelectric layer in a region opposite to the pressure generating chamber, forming an intermediate film made of a conductive material on the piezoelectric layer, forming a protective film on the intermediate film and, using the protective film as a mask, patterning by etching the piezoelectric layer together with the intermediate film into a predetermined pattern, and peeling off the protective film and depositing the upper electrode film on the passage forming substrate and the intermediate film.

The above as well as additional features and objectives of the present invention will become apparent in the following description in conjunction with the accompanying drawings.

BRIEF DESCRIPTION OF THE DRAWINGS

For a more complete understanding of the present invention and the advantages thereof, reference is now made to the following descriptions in conjunction with the accompanying drawings.

DESCRIPTION OF THE PREFERRED EMBODIMENTS

Figure 1:
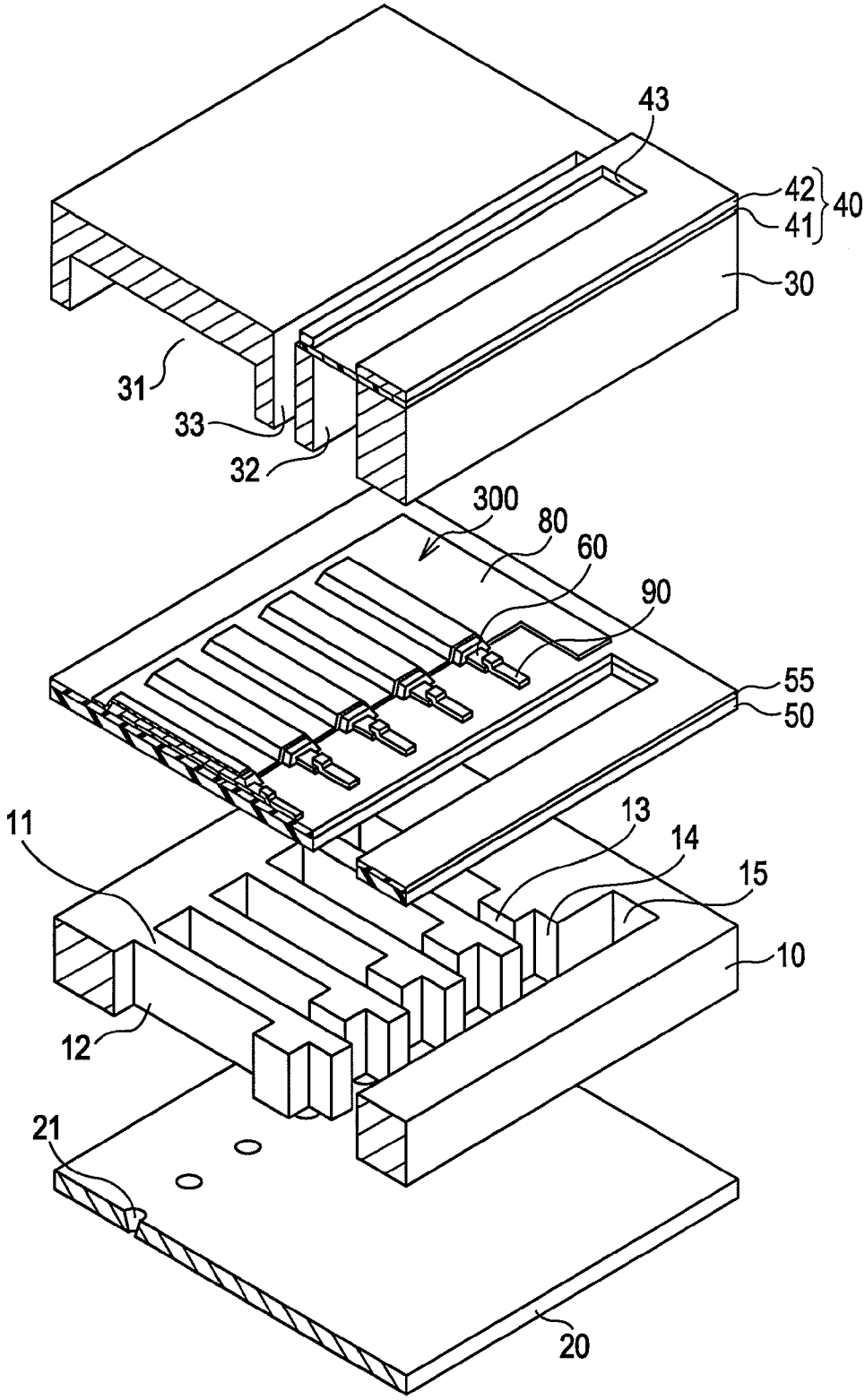
FIG. 1 is an exploded perspective view of a recording head according to Embodiment 1 of the present invention.

At least the following will become apparent from the following descriptions and the accompanying drawings.

As an embodiment of a liquid jet head, a method of manufacturing a liquid jet head includes forming a pressure generating chamber in a passage forming substrate, forming a lower electrode film having a smaller width than the pressure generating chamber in a region opposite to the pressure generating chamber, forming a piezoelectric layer so as to cover the top and end faces of the lower electrode film in a region opposite to the pressure generating chamber, forming an upper electrode film so as to cover top and end faces of the piezoelectric layer in a region opposite to the pressure generating chamber, forming an intermediate film made of a conductive material on the piezoelectric layer, forming a protective film on the intermediate film and, using the protective film as a mask, patterning by etching the piezoelectric layer together with the intermediate film into a predetermined pattern, and peeling off the protective film and depositing the upper electrode film on the passage forming substrate and the intermediate film.

Since the piezoelectric layer is patterned together with the intermediate film, the intermediate film, for example, plays a role as a barrier when the protective film is peeled off, resulting in almost no peeling solution adhering to the piezoelectric layer. This prevents damage to the piezoelectric layer caused by the peeling solution, which leads to the manufacture of a liquid jet head provided with a piezoelectric element having good displacement properties. Also, the intermediate film is formed of a conductive material and comes into contact with the upper electrode, thereby complementing conductive properties as the upper electrode.

Furthermore, as another embodiment of a liquid jet head, a method of manufacturing a liquid jet head uses a metallic material having an ionization tendency equal to or smaller than a material of the upper electrode film.

In particular, it is preferable to use any one selected from among groups including iridium, platinum, and palladium as the material of the intermediate film.

This allows the intermediate film to securely function as a protective film against an acid solution, thereby more securely preventing damage to the piezoelectric layer.

Furthermore, the upper electrode film is formed so as to be thicker than the intermediate film and have a thickness of 30 μm or more.

This more securely prevents water content (moisture) from penetrating into the piezoelectric layer.

In addition, a liquid jet apparatus provided with a liquid jet head manufactured by the above described manufacturing method is provided.

Use of this liquid jet head ensures that a highly reliable liquid jet apparatus is provided.

A preferred embodiment of the present invention will now be described below with reference to the accompanying drawings. The embodiment to be described below is described as an example of the present invention, and not all of the components to be presented below constitute the essential components of the present invention.

BEST MODE FOR CARRYING OUT THE INVENTION

An embodiment of the present invention is described below on the basis of the accompanying drawings.

Embodiment 1

Figure 2:
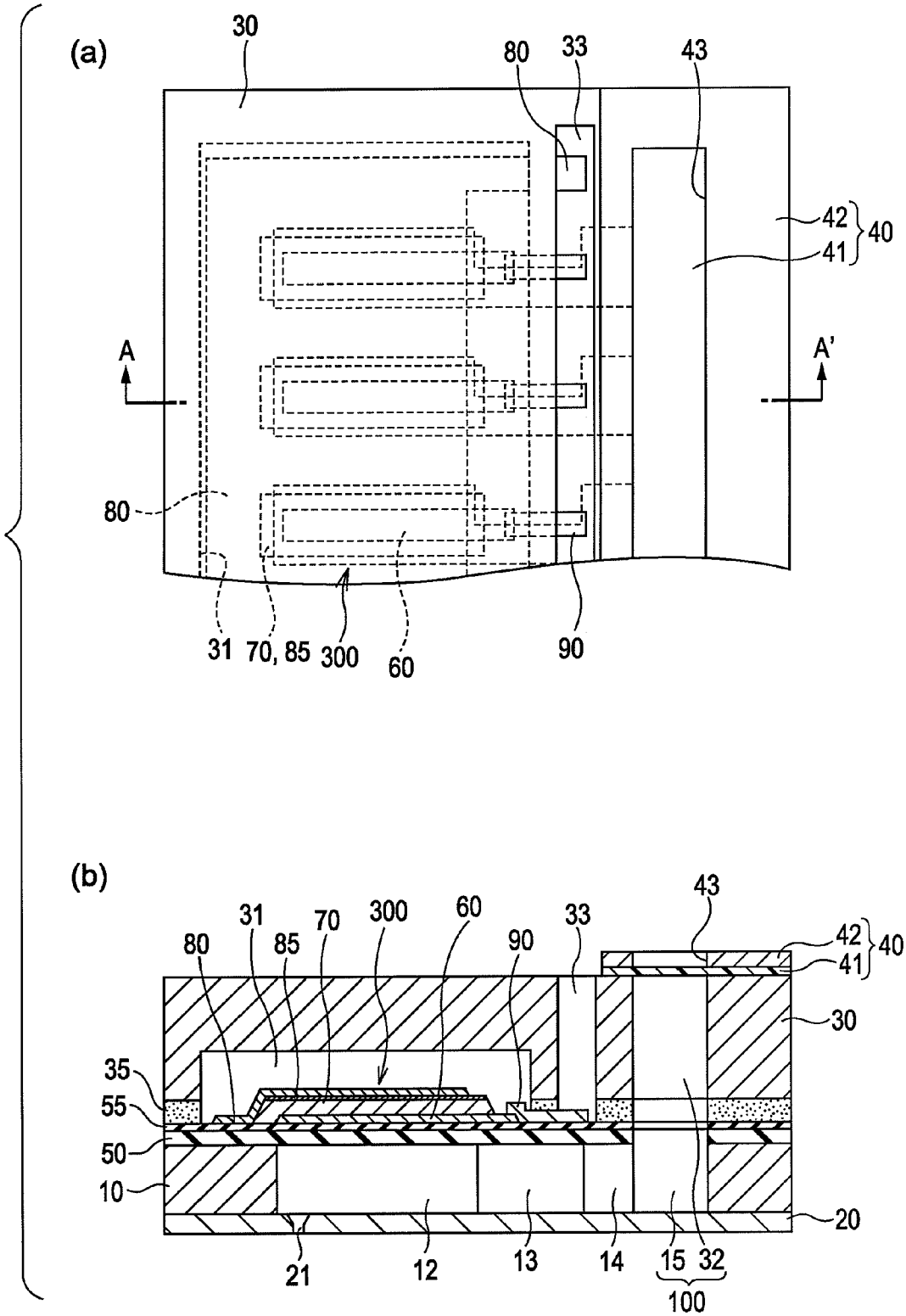
FIG. 2 is a plan view and a cross-sectional view of a recording head according to Embodiment 1 of the present invention.

FIG. 1 is an exploded perspective view showing a structure of an ink jet recording head as an example of a liquid jet head manufactured by the manufacturing method according to Embodiment 1 of the present invention. FIG. 2 is a plan view of an ink jet recording head shown in FIG. 1 and a cross-sectional view taken along the line A-A'.

As shown in figures, in this embodiment a passage forming substrate 10 is made of a silicon single crystal substrate having a crystal face orientation of (110) and has an elastic film 50 made of an oxide film formed at one face thereof. The passage forming substrate 10 includes a plurality of pressure generating chambers 12 disposed in parallel with each other in the breadthwise direction thereof, each of the plurality of pressure generating chambers 12 being defined by a partition wall and constructed at one face thereof with the elastic film 50.

The passage forming substrate 10 includes an ink supply passage 13 and a communicating passage 14 formed at one lengthwise end of the pressure generating chamber 12, the ink supply passage 13 and the communicating passage 14 being defined with the partition wall 11 and communicating with the pressure generating chamber 12. A communicating section 15 communicating with the communicating passage 14 is provided outside of the communicating passage 14. The communicating section 15 communicates with a reservoir section 32 of a protective substrate 30 to be mentioned later to form part of a reservoir 100, which constitutes an ink chamber (liquid chamber) common to each of the pressure generating chambers 12.

The ink supply passage 13 is designed to have a smaller cross section than the pressure generating chamber 12 in order to allow ink flowing from the communicating section 15 into the pressure generating chamber 12 to have a constant flow resistance. For example, the ink supply passage 13 is formed so as to have a smaller width than the pressure generating chamber 12 by narrowing a passage going through the reservoir 100 and the pressure generating chamber 12 at a position on the side of the pressure generating chamber 12. In this embodiment, the ink supply passage is formed by narrowing the passage at one breadthwise side thereof, but may be formed by narrowing the passage at both breadthwise sides thereof. Also, the ink supply passage may be formed by narrowing the passage in the thickwise direction, instead of narrowing the passage in the breadthwise direction. The communicating passage 14 is formed by extending the partition walls 11 at both breadthwise sides of the pressure generating chamber 12 to the communicating section 15 and thereby defining a space between the ink supply passage 13 and the communicating section 15.

In this embodiment, the passage forming substrate 10 uses a silicon single crystal substrate as a material. Needless to say, the material is not limited to this, and another material such as a glass ceramic or stainless steel may be used.

The passage forming substrate 10 has a nozzle plate 20 mounted at an open side thereof by an adhesive or a hot melt film or the like, the nozzle plate 20 having a nozzle 21 communicating with the end of the pressure generating chamber 12 opposite the ink supply passage 13. The nozzle plate 20 is made of, for example, a glass ceramic, a silicon single crystal substrate, stainless steel or the like.

Meanwhile, the passage forming substrate 10 has the above mentioned elastic film 50 formed at the side opposite to the open side, and an insulator film 55 made of an oxide film of a different material from the elastic film 50 is formed on the elastic film 50. In addition, a piezoelectric element 300 consisting of a lower electrode film 60, a piezoelectric layer 70, and an upper electrode film 80 is formed on the insulator film 55. The piezoelectric element 300 includes portions having at least the piezoelectric layer 70, in addition to portions having the lower electrode film 60, the piezoelectric layer 70, and the upper electrode film 80. Generally, any one electrode of the piezoelectric element 300 is used as a common electrode, while an individual electrode is formed by patterning the other electrode together with the piezoelectric layer 70 for each of the pressure generating chambers 12. As used herein, the piezoelectric element 300 together with a vibration plate producing a displacement by operation of the piezoelectric element 300 is called an actuator unit.

Figure 3:
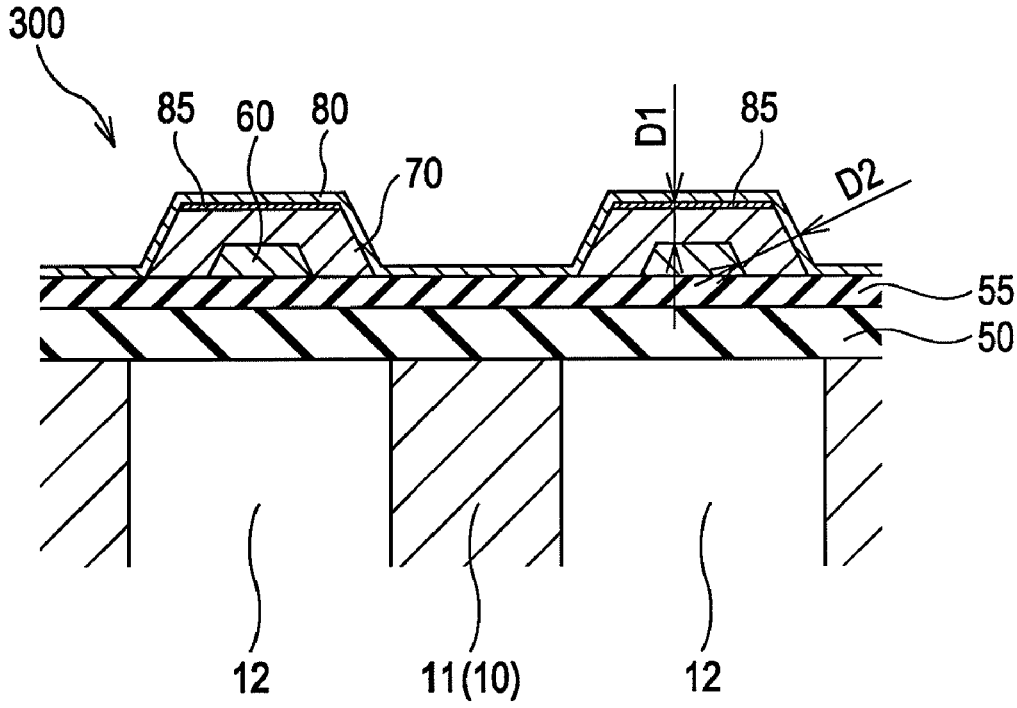
FIG. 3 is a cross-sectional view showing a structure of a piezoelectric element of a recording head according to Embodiment 1 of the present invention.

The structure of the piezoelectric element 300 according to this embodiment is detailed below. As shown in FIG. 3, the lower electrode film 60 constituting the piezoelectric element 300 is formed so as to have a smaller width than the pressure generating chamber 12 in a region opposite to the pressure generating chamber 12, thereby forming an individual electrode of the piezoelectric element 300. Also, the lower electrode film 60 extends onto a peripheral wall from one lengthwise end of the pressure generating chamber 12. The lower electrode film 60 is connected to a lead electrode 90 made of, for example, gold (Au) in a region outside of the pressure generating chamber 12. The piezoelectric element 300 is subjected to a selective voltage application through the lead electrode 90. Meanwhile, the end of the lower electrode film 60 at the side of the other lengthwise end of the pressure generating chamber 12 is located in a region opposite to the pressure generating chamber 12.

The piezoelectric layer 70 is formed so as to have a larger width than the lower electrode film 60 and a smaller width than the pressure generating chamber 12. Both ends of the piezoelectric layer 70 extend outside of the ends of the pressure generating chamber 12 in the lengthwise direction of the pressure generating chamber 12. In other words, the piezoelectric layer 70 is formed so as to completely cover the top and end faces of the lower electrode film 60 in a region opposite to the pressure generating chamber 12. The end of the piezoelectric layer 70 at the side of one lengthwise end of the pressure generating chamber 12 is located close to the end of the pressure generating chamber 12, and the lower electrode film 60 further extends outside the end.

The upper electrode film 80 is formed in a continuous manner in regions opposite to a plurality of the pressure generating chambers 12, and extends onto a peripheral wall from the other lengthwise end of the pressure generating chamber 12. In other words, the upper electrode film 80 is formed so as to completely cover the top and end faces of the piezoelectric layer 70 in a region opposite to the pressure generating chamber 12. This substantially prevents water content (moisture) of the atmosphere from penetrating into the piezoelectric layer 70. Accordingly, this prevents damage to the piezoelectric element 300 (piezoelectric layer 70) caused by water content (moisture), resulting in a significant improvement in the durability of the piezoelectric element 300.

The end of the upper electrode film 80 at the side of the other lengthwise end of the pressure generating chamber 12 is located in a region opposite to the pressure generating chamber 12, and a substantial driving section for the piezoelectric element 300 is provided in a region opposite to the pressure generating chamber 12. In other words, a section of the piezoelectric element 300 between the end of the lower electrode film 60 and the end of the upper electrode film 80, which is located inside the pressure generating chamber 12, is a substantial driving section. Accordingly, the piezoelectric element 300, when driven, causes a vibration plate (elastic film 50, insulator film 55) to produce no large deformation at positions close to both lengthwise ends of the pressure generating chamber 12, thereby preventing a crack from occurring at such positions of the vibration plate. In this arrangement, a small part of the surface of the piezoelectric layer 70 is exposed in a region opposite to the pressure generating chamber 12. However, since such a part is not a substantial driving section and has a very small area, and there is a large distance between the peripheral portion of the upper electrode film 80 and the lower electrode film 60, as mentioned later, damage to the piezoelectric layer 70 caused by moisture can be prevented.

An intermediate film 85 is provided between the upper electrode film 80 and the piezoelectric layer 70. The intermediate film 85 is made of a conductive material, and substantially functions as part of the upper electrode film 80. In other words, due to being made of a conductive material the intermediate film 85 can supplement the conductive property as the upper electrode film 80 when being in contact with the upper electrode film 80. As detailed later, the intermediate film 85 is patterned at the same time as the piezoelectric layer 70 so as to prevent damage to the piezoelectric layer 70 in a manufacturing process. For this reason, the intermediate film 85 is formed only on the upper surface of the piezoelectric layer 70.

It is preferable that the piezoelectric layer 70 constituting the piezoelectric element 300 meets the following relationship regarding thickness. Specifically, the thickness of the piezoelectric layer 70 formed on the upper surface of the lower electrode film 60, namely the distance D1 between the upper surface of the lower electrode film 60 and the upper surface of the piezoelectric layer 70, and the thickness of the piezoelectric layer 70 formed on the slanted end surface of the lower electrode film 60, namely, the distance D2 between the end surface of the lower electrode film 60 and the end surface of the piezoelectric layer 70 preferably have the relationship of D2□D1 (see FIG. 3). In other words, it is preferable that the thickness D2 of the piezoelectric layer 70 on the end surface of the lower electrode film 60 is more than the thickness D1 of the piezoelectric layer 70 formed on the upper surface of the lower electrode film 60, which contributes to driving of the piezoelectric element 300.

This arrangement ensures that a sufficient clearance is maintained between the upper electrode film 80 (intermediate film 85) on the end surface of the piezoelectric layer 70 and the lower electrode film 60, thereby preventing dielectric breakdown from occurring between the upper electrode film 80 and the lower electrode film 60. Accordingly, damage to the piezoelectric element 300 can be prevented, which will lead to the implementation of an ink jet recording head having improved durability.

Figure 4:
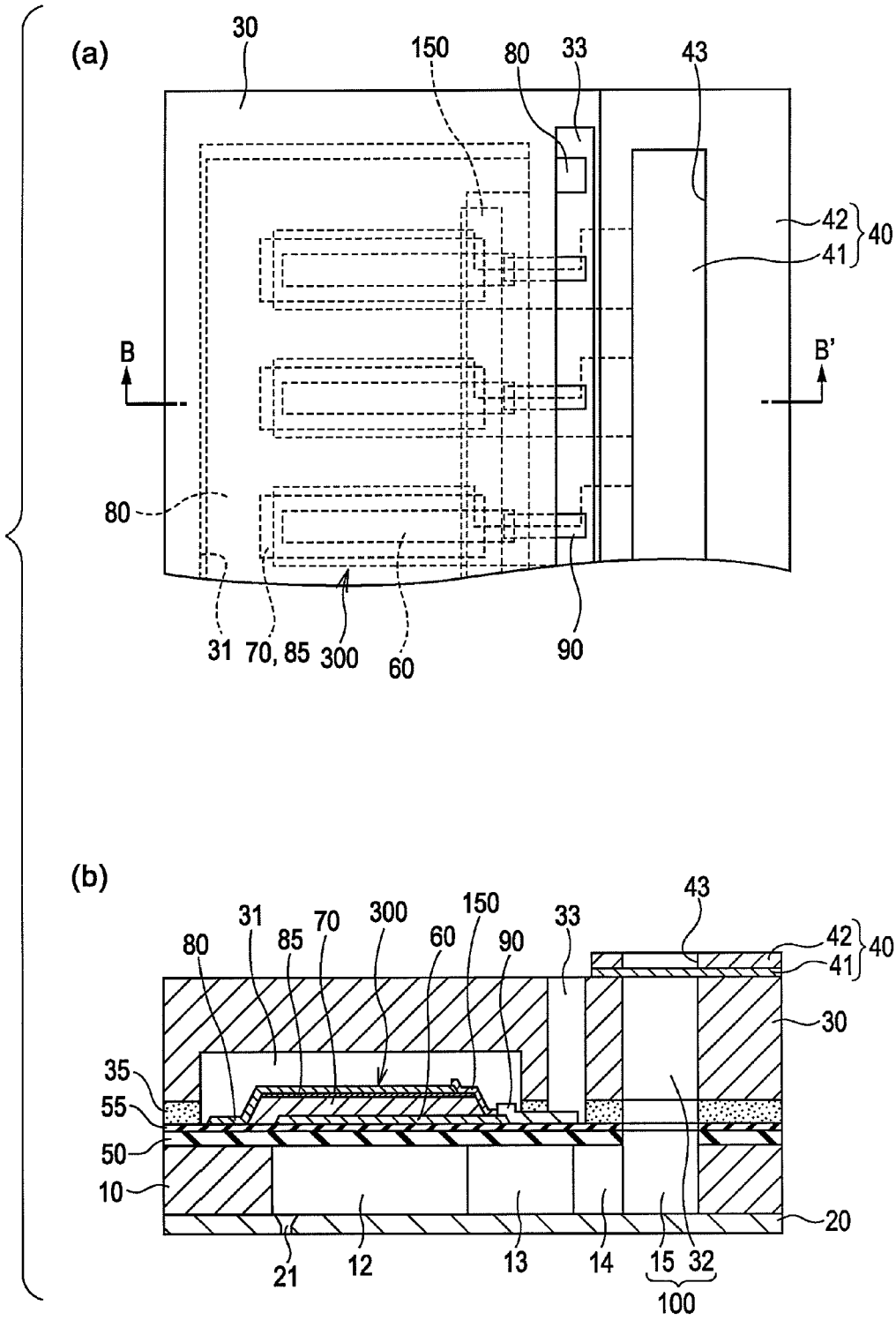
FIG. 4 is a plan view and a cross-sectional view showing modifications to a recording head according to Embodiment 1 of the present invention.

As shown in FIG. 4, a protective film 150 made of a material having moisture-absorption characteristics, such as aluminum oxide or the like, may be provided so as to cover the surface of the piezoelectric layer 70 exposed to the peripheral portion of the upper electrode film 80 and a region opposite to the pressure generating chamber 12. This arrangement more securely prevents damage to the piezoelectric layer 70 caused by moisture.

A protective substrate 30 having a piezoelectric element retaining section 31 is joined with an adhesive 35 onto the passage forming substrate 10 having the piezoelectric element 300 formed thereon, the piezoelectric element retaining section 31 being in a region opposite to the piezoelectric element 300 and having a space large enough to allow the piezoelectric element 300 to move without any difficulties. The piezoelectric element 300 is provided inside the piezoelectric element retaining section 31, and therefore is negligibly subject to the effects of the outside environment. The protective substrate 30 includes a reservoir section 32 formed in a region corresponding to the communicating section 15 in the passage forming substrate 10. In this embodiment, the reservoir section 32 penetrates through the protective substrate 30 in the thickwise direction so as to extend along the pressure generating chambers 12 disposed in parallel, and, as described above, communicates with the communicating section 15 in the passage forming substrate 10, thereby constituting the reservoir 100 which is an ink chamber shared by each of the pressure generating chambers 12.

Furthermore, a through hole 33 penetrating through the protective substrate 30 in the thicknesswise direction is provided in a region between the piezoelectric element retaining section 31 and the reservoir 32 in the protective substrate 30. The ends of the upper electrode film 80 and the lead electrode 90 are exposed to the through hole 33. In addition, the lower electrode film 60 and the lead electrode 90 (not illustrated) are connected to a driving IC for driving the piezoelectric element 300 through a connecting wire provided to extend into the through hole 33.

The protective substrate 30 uses, for example, glass, a ceramic material, metal, a resin or the like as a material, and is preferably made of a material substantially equal in terms of coefficient of thermal expansion to the passage forming substrate 10. In this embodiment, the protective substrate 30 is formed of the same silicon single crystal substrate as the passage forming substrate 10.

A compliance substrate 40 consisting of a sealing film 41 and a fixed plate 42 is joined onto the protective substrate 30. The sealing film 41 is made of a flexible material having low stiffness, and is used to seal one side of the reservoir section 32. The fixed plate 42 is made of a hard metallic material. The fixed plate 42 includes an opening 43 formed therein, which is formed by removing a region opposite to the reservoir 100 from the fixed plate 42. Accordingly, one side of the reservoir 100 is sealed only by the flexible sealing film 41.

An ink jet recording head according to this embodiment takes in an ink from an external ink supply unit (not illustrated), fills the reservoir 100 through the nozzle 21 with the ink, and then applies a voltage to the respective piezoelectric element 300 corresponding to each of the pressure generating chambers 12 in accordance with a recording signal from an driving IC (not illustrated) to deform the piezoelectric element 300, which raises a pressure in the pressure generating chamber 12, thereby jetting ink droplets through the nozzle 21.

A method of manufacturing the ink jet recording head is described below with reference to FIGS. 5 through 8. FIGS. 5 through 8 are cross-sectional views showing the manufacturing processes of the ink jet recording head.

Figure 5:
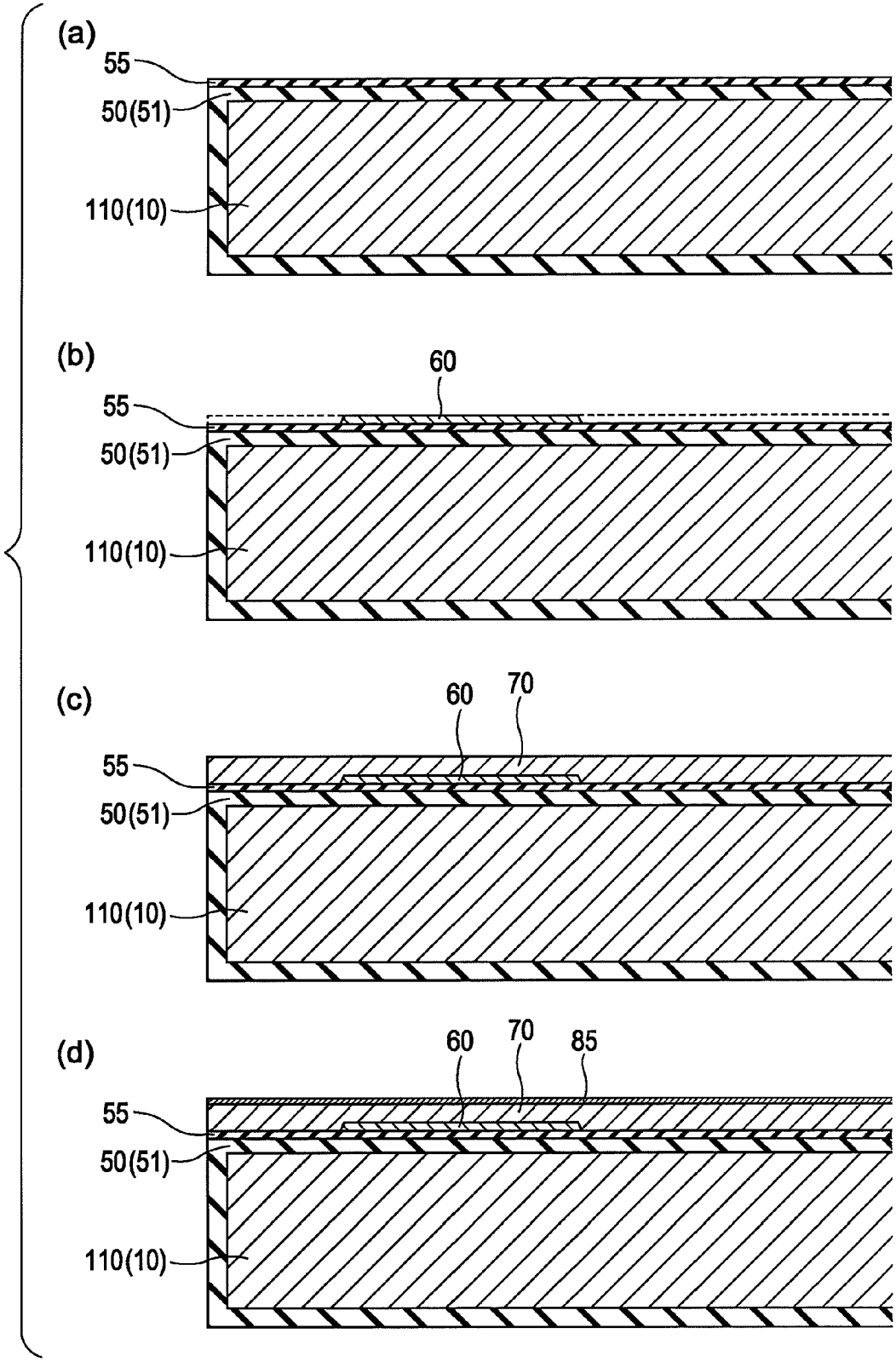
FIG. 5 is a cross-sectional view showing a manufacturing process of a recording head according to the present invention.

As shown in FIG. 5(*a*), a silicon dioxide film 51 constituting the elastic film 50 is formed on a surface of a passage forming substrate wafer 110, a silicon wafer of a silicon single crystal substrate having a crystal face orientation of (110), and the insulator film 55 consisting of zirconium oxide is formed on the elastic film 50 (silicon dioxide film 51). Then, as shown in FIG. 5(*b*), the lower electrode film 60 is formed by laminating, for example, platinum (Pt) and iridium (Ir) on the insulator film 55 by sputtering, and is patterned into a predetermined pattern.

Then, as shown in FIG. 5(*c*), the piezoelectric layer 70 made of, for example, lead zirconate titanate (PZT) or the like is deposited on the entire surface of the passage forming substrate wafer 110 having the lower electrode film 60 formed thereon. The piezoelectric layer 70 constituting the piezoelectric element 300 uses as a material, for example, a ferroelectric material such as lead zirconate titanate (PZT), or a relaxor ferroelectric to which a metal such as niobium, nickel, magnesium, bismuth or yttrium is added. Selection of its composition depends on the characteristics and applications of the piezoelectric element 300. Although no limitations are placed on a forming method of the piezoelectric layer 70, this embodiment forms the piezoelectric layer 70 by using, for example, a so-called sol-gel method where a so-called sol including a metal organic substance dissolved and dispersed in a solvent is coated and dried into a gel which is then calcined at high temperatures to form a metallic oxide which constitutes the piezoelectric layer 70. Needless to say, a method of forming the piezoelectric layer 70 is not limited to the sol-gel method, and the MOD method or sputtering method, for example, may be used.

Then, as shown in FIG. 5(*d*), the intermediate film 85 made of a conductive material is deposited on the entire surface of the piezoelectric layer 70.

Figure 6:
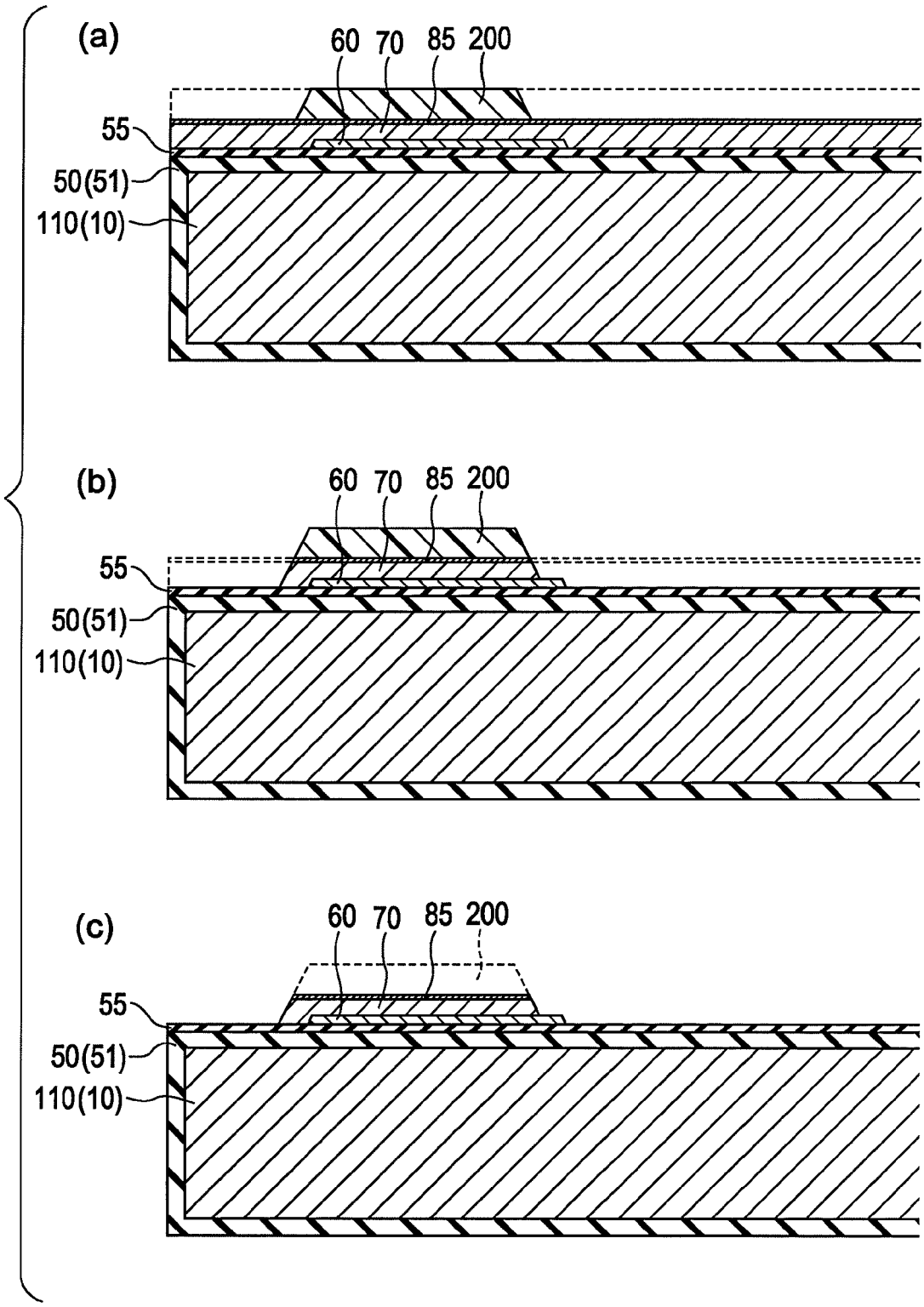
FIG. 6 is a cross-sectional view showing a manufacturing process of a recording head according to the present invention.

In addition, the piezoelectric layer 70 is patterned together with the intermediate film 85 into a predetermined pattern. Specifically, as shown in FIG. 6(*a*), a resist is coated on the intermediate film 85, and the resist is exposed and developed to form a resist film 200 having a predetermined pattern. In other words, a negative resist, for example, is coated on the intermediate film 85 by means of the spin coat method and then exposed, developed, and baked using a predetermined mask to form the resist film 200. Needless to say, a positive resist may be used instead of the negative resist. In this embodiment, the resist film 200 is formed so as to have its end surface slanted at a predetermined angle.

Then, as shown in FIG. 6(*b*), using the resist film 200 of a protective film as a mask, the piezoelectric layer 70 is patterned together with the intermediate film 85 by ion milling into a predetermined pattern. At this time, the piezoelectric layer 70 and the intermediate film 85 are patterned along the slanted end surface of the resist film 200. Part of the lower electrode film 60 is exposed, and the exposed portion of the lower electrode film 60 is slightly etched together with the piezoelectric layer 70 and the intermediate film 85, causing the exposed portion to be somewhat thinner than the other portion of the lower electrode film 60.

Then, as shown in FIG. 6(*c*), the resist film 200 on the intermediate film 85 is caused to be peeled off. Although no limitations are placed on a method for peeling off the resist film 200, an organic peeling solution, for example, may be used for this peeling purpose. After that, the resist film 200 is completely removed by washing the surface of the intermediate film 85 with a predetermined cleaning solution.

The piezoelectric layer 70 constituting the piezoelectric element 300 can be properly formed by patterning the piezoelectric layer 70 according to these procedures. In the present invention, the resist film 200 is formed on the piezoelectric layer 70 via the intermediate film 85 instead of forming the resist film 200 directly on the piezoelectric layer 70, and then the piezoelectric layer 70 is patterned using the resist film 200 as a mask. Accordingly, when the resist film 200 is peeled off and washed with an organic peeling solution or a cleaning solution or the like, the intermediate film, for example, plays a role as a barrier layer, resulting in almost no organic peeling solution adhering to the piezoelectric layer 70. This prevents damage to the piezoelectric layer 70 caused by, for example, an organic peeling solution, a cleaning solution or the like. If the organic peeling solution is an acid or alkaline solution, such an organic peeling solution or a cleaning solution adheres to the piezoelectric layer 70, which may cause the piezoelectric layer 70 to suffer from, for example, lead deficiency or oxygen defect formation. However, the intermediate film 85 formed on the piezoelectric layer 70 prevents damage to the piezoelectric layer 70, as described above.

No limitations are placed on a material of the intermediate film 85 as long as such a material has a conductive property. More preferably, a metallic material having an ionization tendency equal to or smaller than the upper electrode film 80, such as iridium, platinum, palladium or the like is used. Most preferably, a metallic material having an ionization tendency smaller than hydrogen, such as iridium, platinum or the like is used. Even if an acid solution is used to peel off and wash the resist film 200, use of such a material does not allow the acid solution to remove the intermediate film 85, securely protecting the piezoelectric layer 70.

Since the intermediate film 85 substantially doubles as the upper electrode film 80, it is preferable that the intermediate film 85 is made of a relatively highly conductive material. Also, preferably the intermediate film 85 is formed to be thin to such a degree that the piezoelectric layer 70 is securely protected. A thickness of, for example, not less than 5 μm and not more than 50 μm is more preferable. This arrangement allows the piezoelectric element 300 to be properly displaced even if the intermediate film 85 is formed on the piezoelectric layer 70.

Figure 7:
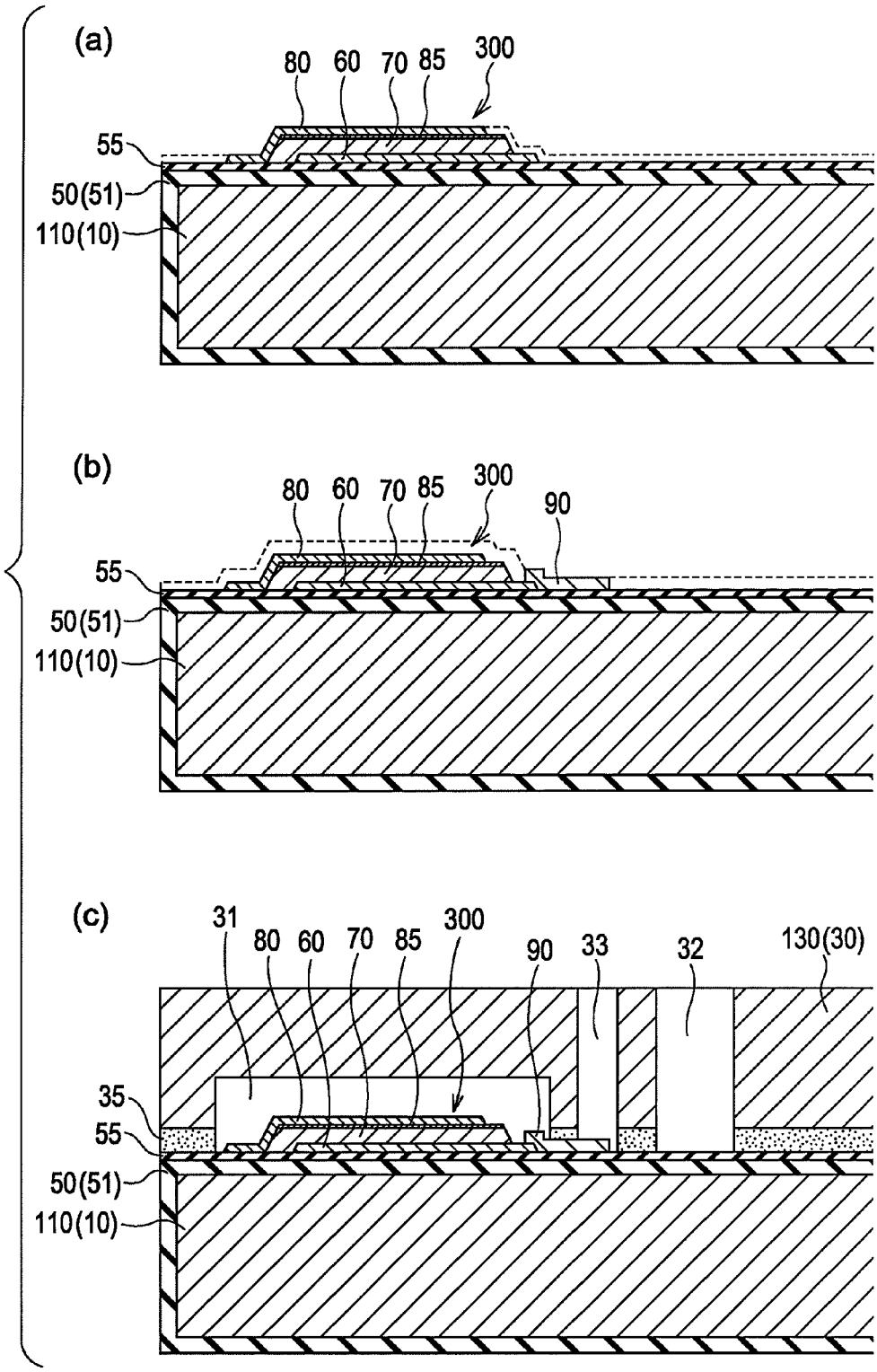
FIG. 7 is a cross-sectional view showing a manufacturing process of a recording head according to the present invention.

After the resist film 200 is removed from the intermediate film 85, the upper electrode film 80 is formed on the entire surface of the passage forming substrate wafer 110, and then the upper electrode film 80 is patterned into a predetermined pattern to form the piezoelectric element 300, as shown in FIG. 7(*a*).

No limitations are placed on a material of the upper electrode film 80 as long as such a material has a relatively high conductive property. Preferably, a metallic material, such as iridium, platinum, palladium or the like is used. Also, the upper electrode film 80 should be formed to be thick to such a degree that a displacement of the piezoelectric element 300 is not impeded. Since the upper electrode film 80 doubles as a moisture-resistant protective film for preventing damage to the piezoelectric element 300 caused by water content, it is preferably formed to be relatively thick. Specifically, the upper electrode film 80 is more preferably formed to have a thickness of 30 μm or more.

Then, as shown in FIG. 7(*b*), a gold (Au) lead electrode 90 is formed on the entire surface of the passage forming substrate wafer 110 and patterned for each of the piezoelectric elements 300. Then, as shown in FIG. 7(*c*), a protective substrate wafer 130 having a plurality of protective substrates 30 formed in an integral manner is joined to the passage forming substrate wafer 110 with the adhesive 35. The protective substrate wafer 130 has the piezoelectric element retaining section 31, the reservoir section 32, and the through hole 33 formed in advance therein.

Figure 8:
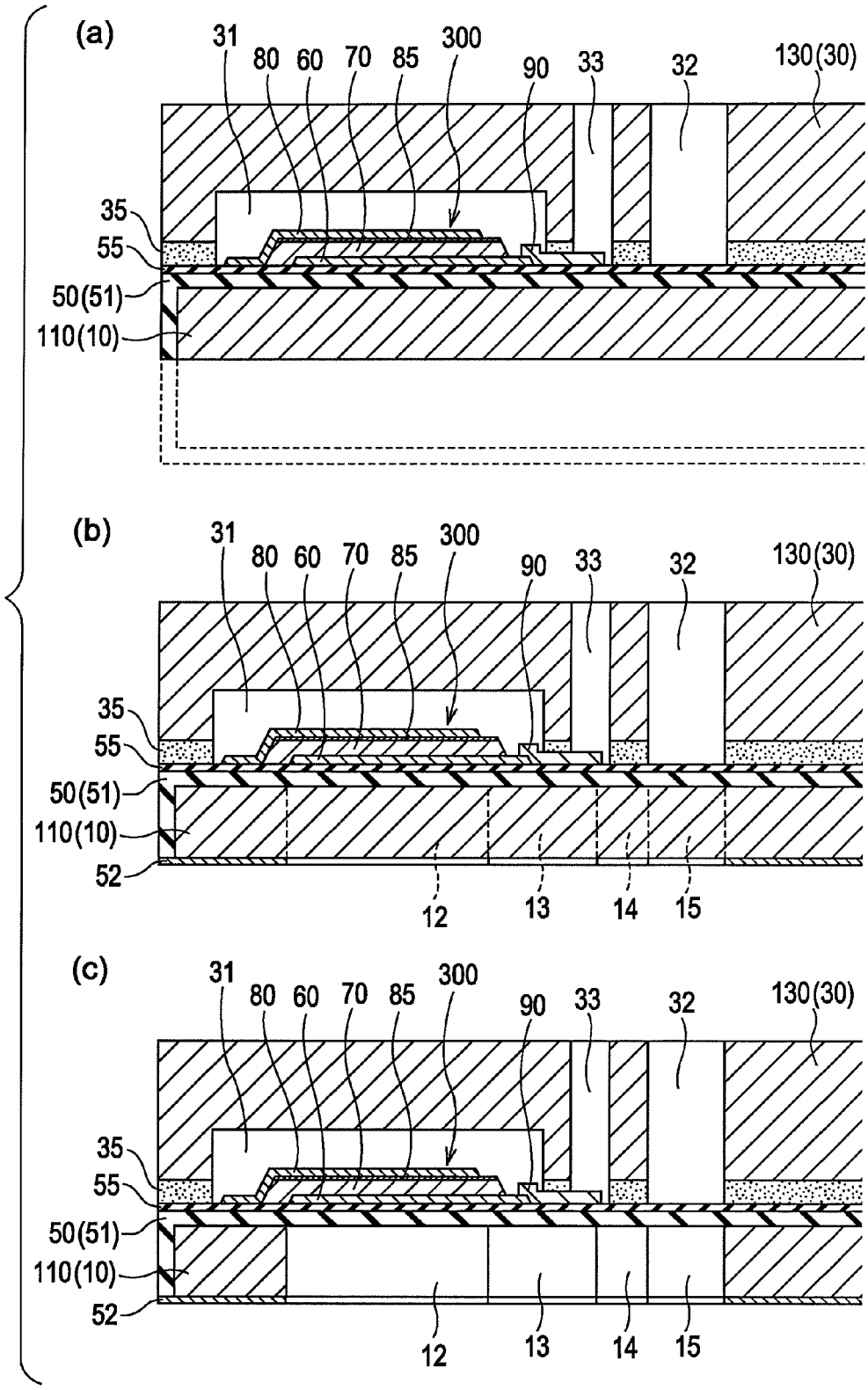
FIG. 8 is a cross-sectional view showing a manufacturing process of a recording head according to the present invention.

Then, as shown in FIG. 8(*a*), the passage forming substrate wafer 110 is thinned into a predetermined thickness. Then, as shown in FIG. 8(*b*), a protective film 52 of, for example, silicon nitride (SiN) is newly formed on the passage forming substrate wafer 110, and the protective film 52 is patterned via a predetermined mask into a predetermined pattern. As shown in FIG. 8(*c*), using the protective film 52 as a mask, the passage forming substrate wafer 110 is anisotropically etched (wet etching) with an alkaline solution such as KOH or the like to form the pressure generating chamber 12, the ink supply passage 13, the communicating passage 14, and the communicating section 15 in the passage forming substrate wafer 110.

After that, unwanted parts (not illustrated) on the peripheral edge of the passage forming substrate wafer 110 and the protective substrate wafer 130 are removed by, for example, die cutting, and the nozzle plate 20 and the compliance substrate 40 are joined to the passage forming substrate wafer 110 and the protective substrate wafer 130, respectively. Then the passage forming substrate wafer 110 is divided into chips each having a size shown in FIG. 1 to form an ink jet recording head.

An exemplary method of manufacturing an ink jet recording head according to the present invention is described above. The present invention is applicable to an ink jet recording head having a structure where a piezoelectric layer is covered at its top and end surfaces with an upper electrode film.

A structure of an ink jet recording head to which the present invention can be applied is described below as another embodiment.

Embodiment 2

Figure 9:
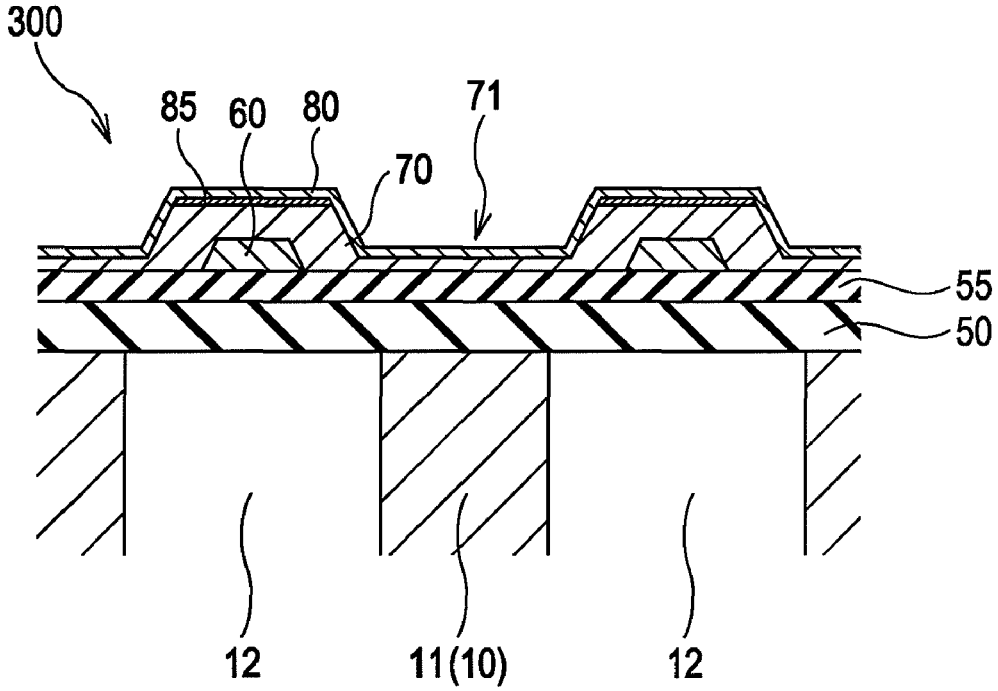
FIG. 9 is a cross-sectional view showing a structure of a piezoelectric element of a recording head according to Embodiment 2 of the present invention.

FIG. 9 is a cross-sectional view showing a piezoelectric element constituting an ink jet recording head according to Embodiment 2. As shown in FIG. 9, in this embodiment, piezoelectric layers 70 are formed in a continuous manner in regions opposite to a plurality of pressure generating chambers 12 provided in parallel. In other words, an ink jet recording head according to Embodiment 2 is the same as that according to Embodiment 1, except that piezoelectric layers 71 thinner than a piezoelectric layer 70 constituting the piezoelectric element 300 are provided among piezoelectric elements 300 formed in parallel. No limitations are placed on the thickness of the piezoelectric layer 71, which may be determined depending on the amount of displacement of the piezoelectric element 300.

The piezoelectric layers 70 formed in a continuous manner as described above prevent a vibration plate, namely an elastic film 50 and an insulator film 55, from being subject to damage when the piezoelectric element 300 is driven. Portions of the vibration plate close to the both breadthwise ends of the pressure generating chamber 12 are prone to cracks due to their significant deformation when the piezoelectric element 300 is driven. However, the piezoelectric layers 70 formed in a continuous manner substantially enhance the rigidity of the vibration plate, preventing the vibration plate from cracking.

As described above, it is preferable that the peripheral edge of the upper electrode film 80 and an exposed surface of the piezoelectric layer 70 are covered with a protective film 150.

Embodiment 3

Figure 10:
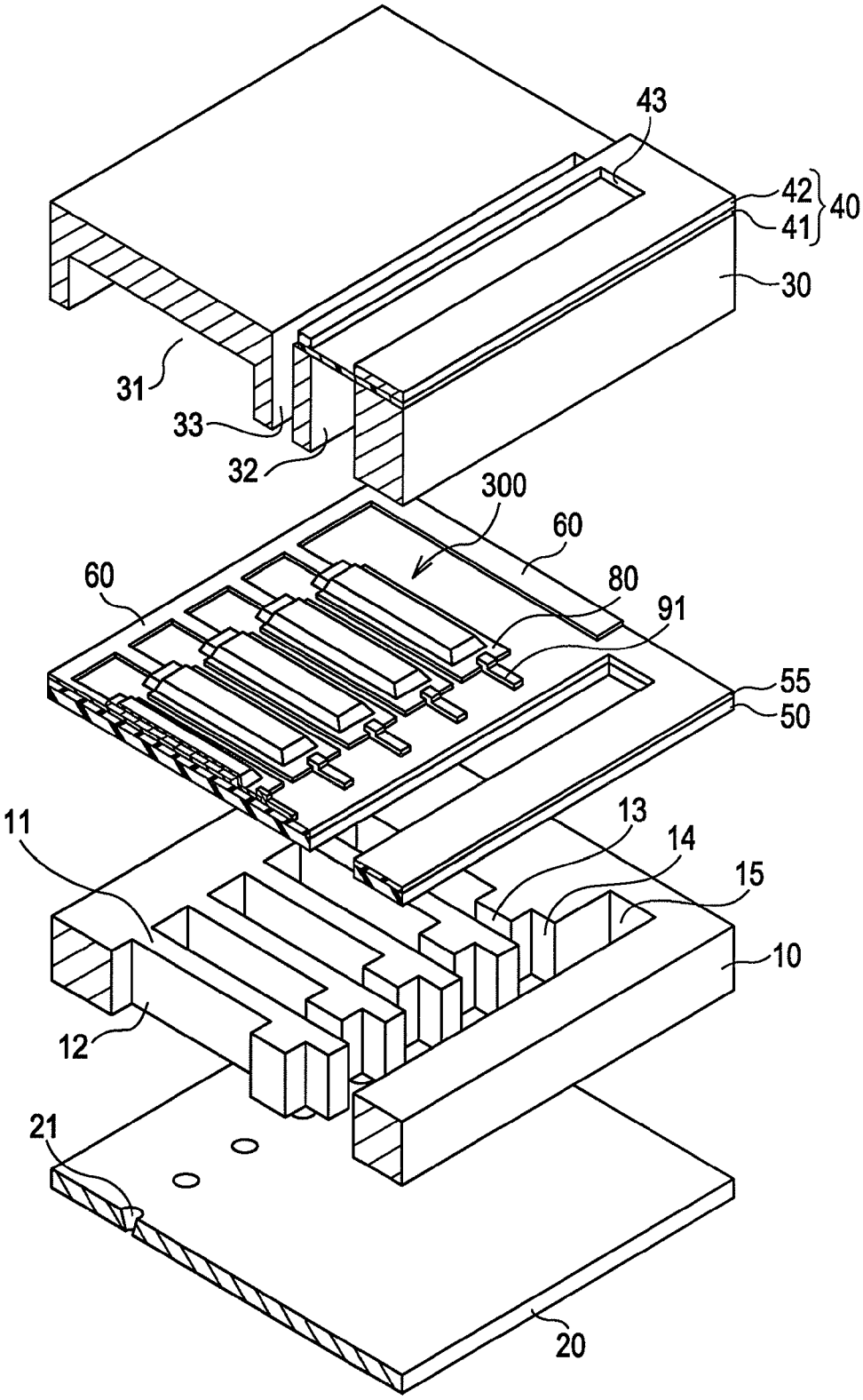
FIG. 10 is an exploded perspective view of a recording head according to Embodiment 3 of the present invention.
Figure 11:
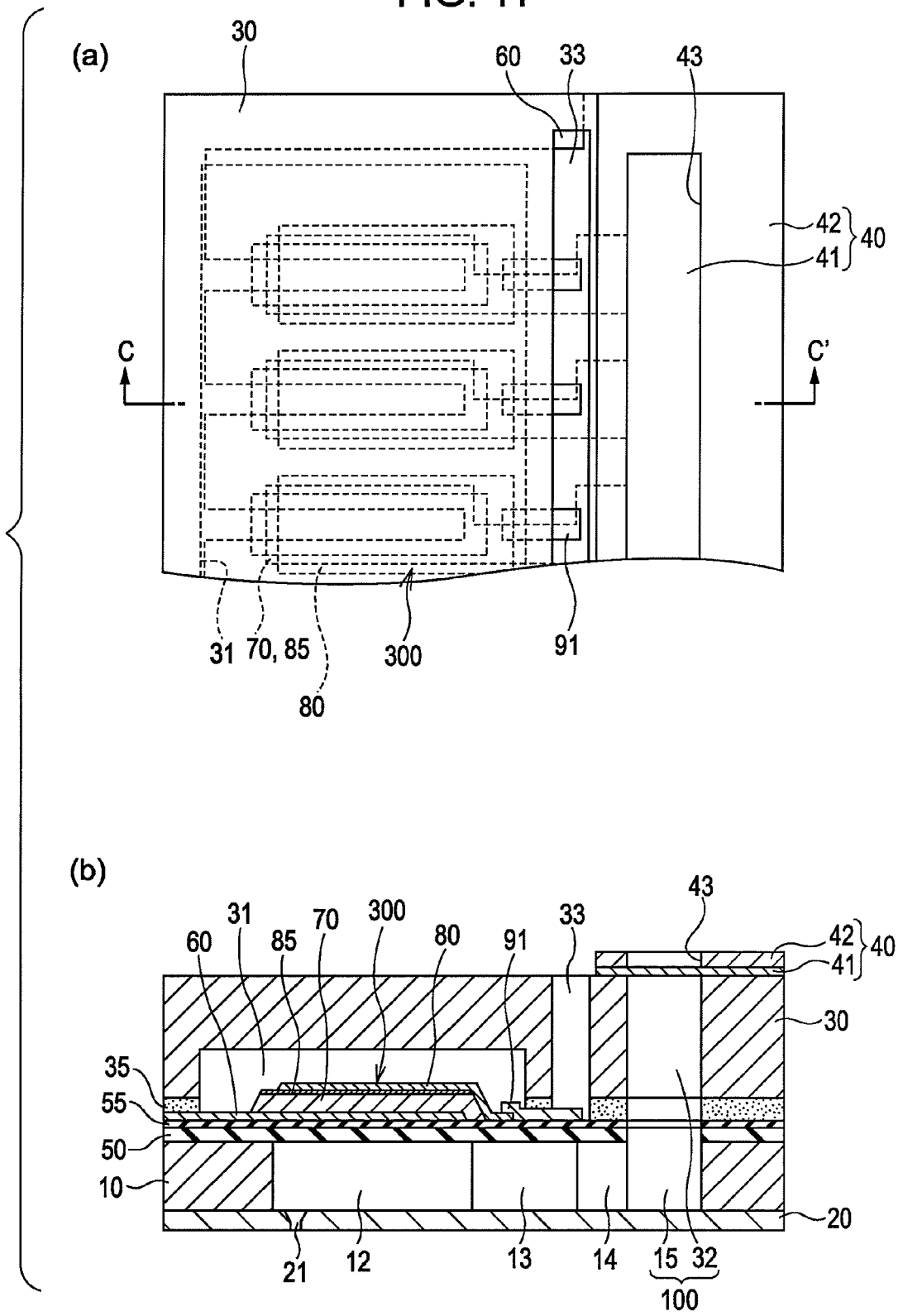
FIG. 11 is a plan view and a cross-sectional view of a recording head according to Embodiment 3 of the present invention.
Figure 12:
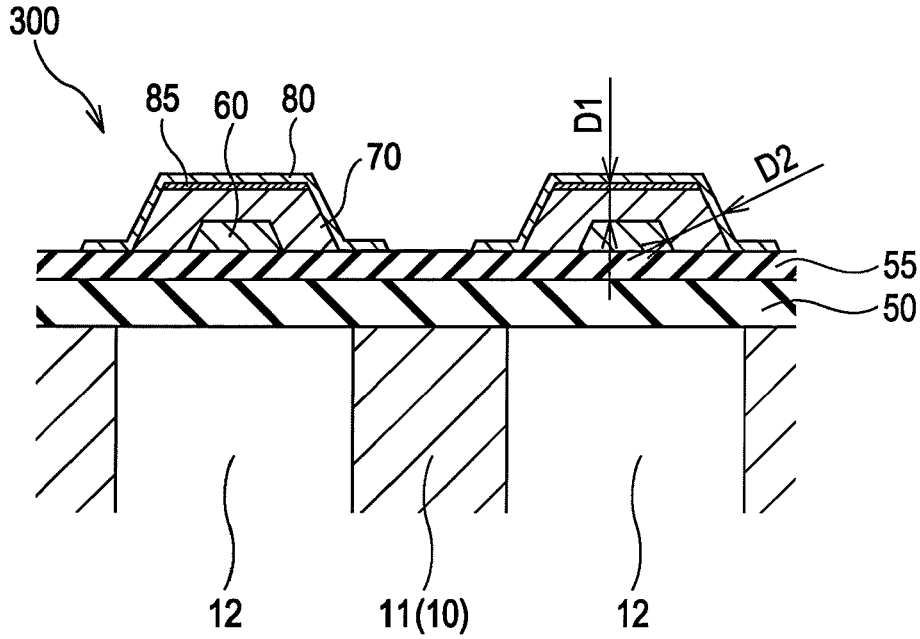
FIG. 12 is a cross-sectional view showing a structure of a piezoelectric element according to Embodiment 3 of the present invention.

FIG. 10 is an exploded perspective view showing the structure of an ink jet recording head according to Embodiment 3. FIG. 11 is a plan view of an ink jet recording shown in FIG. 10 and a cross-sectional view taken along the line C-C'. FIG. 12 is a cross-sectional view showing the structure of a piezoelectric element according to Embodiment 3. The reference numerals and symbols in FIGS. 10 through 12 refer to the same components as those with the reference numerals and symbols in FIGS. 1 through 3, and repeated descriptions of the same components are omitted.

An ink jet recording head according to this embodiment is the same as that according to Embodiment 1, except that a lower electrode film 60 constituting the piezoelectric element 300 constitutes a common electrode of the piezoelectric elements 300, and an upper electrode film 80 constitutes an individual electrode.

As shown in figures, in this embodiment, the lower electrode films 60 each having width smaller than that of the pressure generating chambers 12 extend from one lengthwise ends of the pressure generating chambers 12 onto their peripheral walls in regions opposite to the pressure generating chambers 12, and are coupled together on the peripheral walls to form an electrode common to each of the piezoelectric elements 300. The end of the lower electrode film 60 at the side of the other lengthwise end of the pressure generating chamber 12 is located in a region opposite to the pressure generating chamber 12.

A piezoelectric layer 70 extends outside of the end of the pressure generating chamber 12 along its lengthwise direction, and completely covers the top and end surfaces of the lower electrode film 60 in a region opposite to the pressure generating chamber 12. Also, the lower electrode film 60 extends outside of the piezoelectric layer 70 at one lengthwise end of the pressure generating chamber 12.

Each of the upper electrode films 80 having a larger width than the piezoelectric layer 70 is separately provided in a region opposite to each of the pressure generating chambers 12. In other words, the upper electrode film 80 is divided on partition walls among the pressure generating chambers 12 to form an electrode for each of the piezoelectric elements 300. Also, the upper electrode film 80 extends from the other lengthwise end of the pressure generating chamber 12 onto the peripheral wall. Accordingly, the top and end surfaces of the piezoelectric layer 70 in a region opposite to the pressure generating chamber 12 are completely covered with the upper electrode film 80.

In this embodiment, the upper electrode film 80 extends outside of the end of the piezoelectric layer 70 at the other lengthwise end of the pressure generating chamber 12. The end of the upper electrode film 80 is connected to a lead wire 91, through which a voltage is selectively applied to each of the piezoelectric elements 300.

In a structure according to this embodiment, the distance D1 between the upper surface of the lower electrode film 60 and the upper surface of the piezoelectric layer 70 and the distance D2 between the end surface of the lower electrode film 60 and the end surface of the piezoelectric layer 70 also have the relationship of D2□D1 (see FIG. 12). In other words, the thickness D2 of the piezoelectric layer 70 on the end surface of the lower electrode film 60 is more than the thickness D1 of the piezoelectric layer 70 formed on the upper surface of the lower electrode film 60.

Needless to say, this arrangement also prevents damage to the piezoelectric element 300 caused by water content or the like. In other words, damage to the piezoelectric layer can securely be prevented irrespective of the structure of the piezoelectric element electrode, which leads to the implementation of an ink jet recording head having improved durability.

Figure 13:
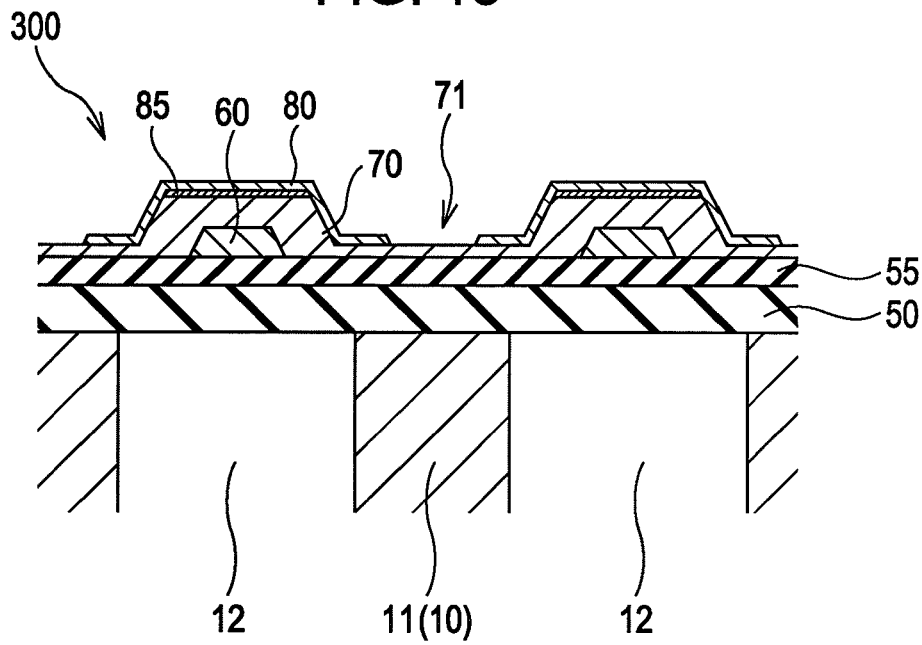
FIG. 13 is a modified structure of a piezoelectric element according to Embodiment 3 of the present invention.

Furthermore in this embodiment, as shown in FIG. 13, piezoelectric layers 70 may be formed in a continuous manner in regions opposite to a plurality of pressure generating chambers 12 provided in parallel, while piezoelectric layers 71 thinner than a piezoelectric layer 70 may be left among piezoelectric elements 300 formed in parallel.

Figure 14:
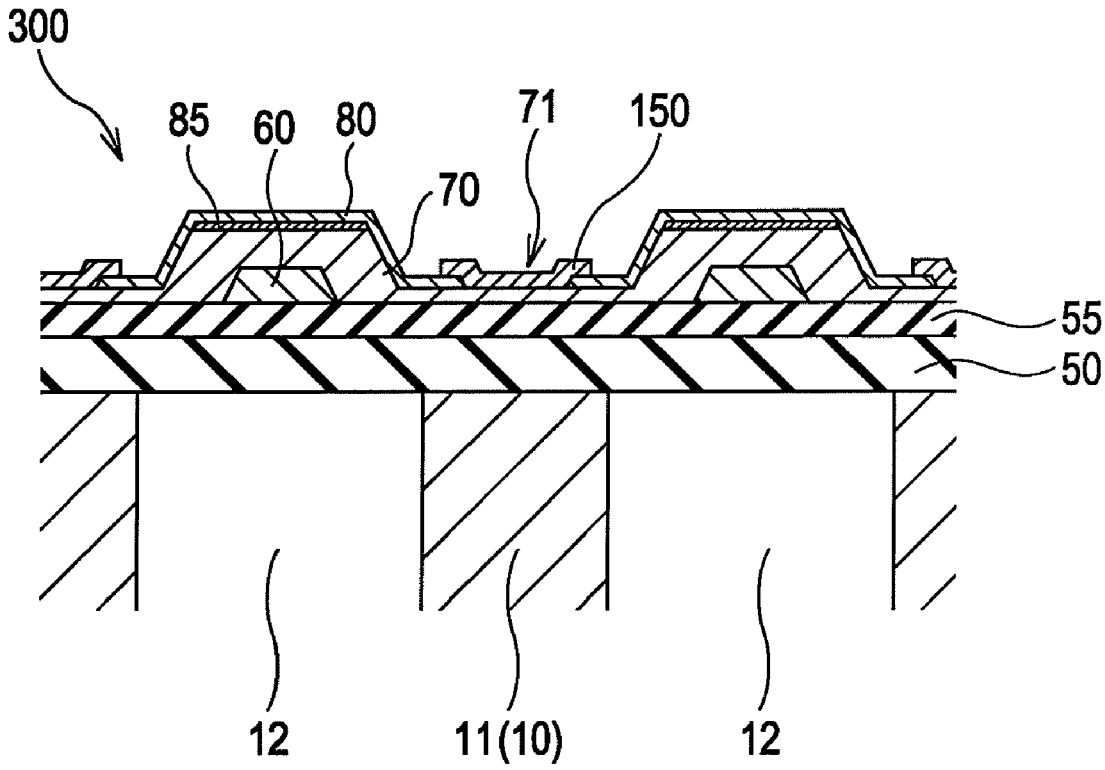
FIG. 14 is a modified structure of a piezoelectric element according to Embodiment 3 of the present invention.

In this structure, the end of the upper electrode film 80 and an exposed surface of the piezoelectric layer 70 are preferably covered with a protective film 150, as described above. Also, in this embodiment, as shown in FIG. 14, the surface of the piezoelectric layer 71 exposed on the partition walls among the pressure generating chambers 12 are preferably covered with the protective film 150. Since part of the piezoelectric layer 71 on the partition wall, namely outside of the pressure generating chamber 12 does not directly contribute to displacement of the piezoelectric element 300, the surface of the piezoelectric layer 71 exposed on the partition wall is not necessarily covered with the protective film 150. However, damage to the piezoelectric layer 70 constituting the piezoelectric element 300 can securely be prevented by covering the surface of the piezoelectric layer 71 exposed on the partition wall with the protective film 150, thereby allowing the piezoelectric element 300 to be properly displaced on a constant basis.

Figure 15:
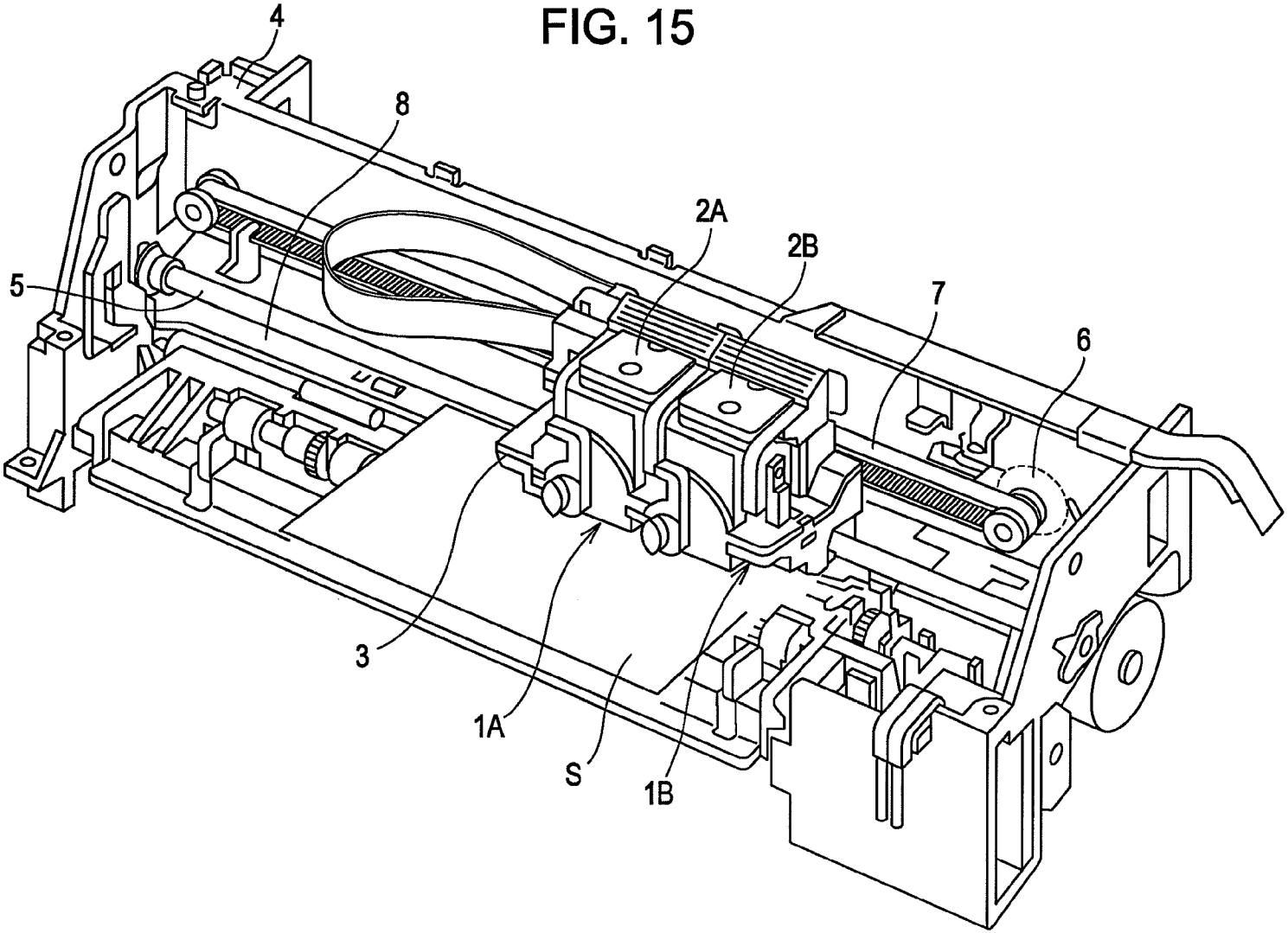
FIG. 15 is an illustration showing an example of a recording apparatus.

An ink jet recording head according to each embodiment described above constitutes part of a recording head unit provided with an ink passage communicating with an ink cartridge or the like, which is then installed to an ink jet recording apparatus. FIG. 15 is an illustration showing an example of such a recording apparatus. As shown in FIG. 15, recording head units 1A and 1B each having an ink jet recording head include cartridges 2A and 2B constituting an ink supply means removably mounted thereon, and a carriage 3 having the recording head units 1A and 2B mounted thereon is provided on a carriage shaft 5 mounted to the apparatus body 4 so as to be movable in the axial direction of the carriage shaft 5. The recording head units 1A and 1B eject, for example, a black ink composition and a color ink composition, respectively. A driving force from a driving motor 6 is transmitted to the carriage 3 via a gear and a timing belt not illustrated, whereby the carriage 3 having the recording head units 1A and 2B mounted thereon moves along the carriage shaft 5. Meanwhile, a platen 8 is provided in the apparatus body 4 along the carriage shaft 5, and a recording sheet S of recording media such as paper fed by a paper feeding roller not illustrated is transported over the platen 8.

The present invention is detailed above. Needless to say, the present invention is not limited to the embodiments described above. Although an ink jet recording head is described in the embodiments above as an example of a liquid jet head according to the present invention, a fundamental structure of a liquid jet head is not limited to a structure described above. The present invention is applicable to a wide range of liquid jet heads and, needless to say, can be applied to a head for jetting a liquid other than an ink. Other liquid jet heads include, for example, various types of recording heads for use in an image recording apparatus such as a printer, a color material jet head for use in the manufacture of a color filter such as a liquid crystal display, an electrode material jet head for use in the electrode formation of an organic EL display or FED (Field Emission Display) or the like, and a bioorganic compound jet head for use in biochip fabrication.

What is claimed is:

1. A method of manufacturing a liquid jet head, comprising:

forming a pressure generating chamber in a passage forming substrate;

forming a lower electrode film having a smaller width than the pressure generating chamber in a region opposite to the pressure generating chamber;

forming a piezoelectric layer so as to cover top and end faces of the lower electrode film in a region opposite to the pressure generating chamber;

forming an upper electrode film so as to cover top and end faces of the piezoelectric layer in a region opposite to the pressure generating chamber;

forming an intermediate film made of a conductive material on the piezoelectric layer;

forming a protective film on the intermediate film and, using the protective film as a mask, patterning by etching the piezoelectric layer together with the intermediate film into a predetermined pattern; and peeling off the protective film and depositing the upper electrode film on the passage forming substrate and the intermediate film.

2. The method of manufacturing the liquid jet head according to claim 1, further comprising: using as a material of the intermediate film a metallic material having an ionization tendency equal to or smaller than a material of the upper electrode film.

3. The method of manufacturing the liquid jet head according to claim 1, further comprising: using any one selected from among groups including iridium, platinum, and palladium as the material of the intermediate film.

4. The method of manufacturing the liquid jet head according to claim 1, further comprising: forming the upper electrode film so as to be thicker than the intermediate film and have a thickness of 30 μm or more.

5. A liquid jet apparatus provided with a liquid jet head manufactured by the manufacturing method disclosed in claim 1.

* * * * *